US009016102B2

(12) United States Patent
Harvey et al.

(10) Patent No.: US 9,016,102 B2
(45) Date of Patent: Apr. 28, 2015

(54) FORMING HAND TOOL

(71) Applicant: Milwaukee Electric Tool Corporation, Brookfield, WI (US)

(72) Inventors: Kyle Harvey, Wauwatosa, WI (US); Michael S. Steele, Waukesha, WI (US); Matthew W. Naiva, Wauwatosa, WI (US); Steven W. Hyma, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 14/184,506

(22) Filed: Feb. 19, 2014

(65) Prior Publication Data

US 2014/0230516 A1 Aug. 21, 2014

Related U.S. Application Data

(60) Provisional application No. 61/766,412, filed on Feb. 19, 2013.

(51) Int. Cl.

| | |
|---|---|
| ***B21D 11/00*** | (2006.01) |
| ***B25B 7/02*** | (2006.01) |
| ***B25B 7/12*** | (2006.01) |
| ***B25B 7/14*** | (2006.01) |
| ***B25G 1/00*** | (2006.01) |
| *B21D 7/06* | (2006.01) |

(52) U.S. Cl.

CPC . *B25B 7/02* (2013.01); *B21D 7/063* (2013.01); *B25B 7/12* (2013.01); *B25B 7/14* (2013.01); *B25G 1/00* (2013.01)

(58) Field of Classification Search

USPC ..... 72/409.1, 409.08, 409.13, 414; 81/420, 81/424.5

See application file for complete search history.

(56) References Cited

U.S. PATENT DOCUMENTS

| | | | |
|---|---|---|---|
| 273,382 | A | 3/1883 | Packham |
| 354,657 | A | 12/1886 | Rowe |
| 515,799 | A | 3/1894 | Smith |
| 905,074 | A | 11/1908 | Hiller |
| 1,066,804 | A | 7/1913 | Falk |
| 1,284,993 | A | 11/1918 | Bellman |
| 2,289,230 | A | 7/1942 | Yingling |
| 2,811,065 | A | 10/1957 | Johnson |

(Continued)

OTHER PUBLICATIONS

Wiss Catalog, publicly available at least as early as Jan. 28, 2014, pp. 249-278.

(Continued)

*Primary Examiner* — David B Jones

(74) *Attorney, Agent, or Firm* — Michael Best & Friedrich LLP

(57) ABSTRACT

A hand tool, such as a duct seamer. The hand tool may include a first handle; a second handle connected to the first handle for pivoting movement about a handle pivot point; a first jaw operably connected to the first handle and having a first inner surface; a second jaw operably connected to the second handle and having a second inner surface; a first groove and a second groove on each of the first inner surface and the second inner surface; and a first shoulder created by the first groove and a second shoulder created by the second groove on each of the first inner surface and the second inner surface, the first shoulders providing a first stop and the second shoulders providing a second stop for the work-piece. The jaws may provide the shoulders at a distance of ⅜ inch and 1 inch from a front of the jaws.

18 Claims, 3 Drawing Sheets

(56) References Cited

U.S. PATENT DOCUMENTS

| | | | | | |
|---|---|---|---|---|---|
| 2,972,270 | A | | 2/1961 | Krolick | |
| 2,990,863 | A | * | 7/1961 | Pantermoller | 81/418 |
| 3,126,773 | A | | 3/1964 | Taylor, Jr. et al. | |
| 3,314,319 | A | | 4/1967 | Schmidt | |
| 3,364,724 | A | | 1/1968 | Schmidt | |
| 3,459,029 | A | | 8/1969 | Rosenfeld et al. | |
| 3,808,870 | A | | 5/1974 | Blancett | |
| 3,842,696 | A | * | 10/1974 | Wayne | 81/424.5 |
| 3,879,981 | A | | 4/1975 | Richards | |
| 4,144,737 | A | | 3/1979 | Izraeli | |
| 4,275,584 | A | | 6/1981 | Kruschel | |
| 4,318,211 | A | | 3/1982 | Hoskinson | |
| 4,386,542 | A | | 6/1983 | Verna | |
| 4,553,422 | A | | 11/1985 | Bilkie | |
| 4,559,805 | A | | 12/1985 | McClure | |
| 4,713,959 | A | | 12/1987 | Bennett | |
| 5,065,608 | A | | 11/1991 | Skelton et al. | |
| 5,095,732 | A | | 3/1992 | Bootka | |
| D335,249 | S | * | 5/1993 | Hopkins | D8/52 |
| 5,222,386 | A | | 6/1993 | Jones, Jr. | |
| D347,984 | S | | 6/1994 | Rippey | |
| 5,661,886 | A | | 9/1997 | Smith | |
| 5,902,015 | A | | 5/1999 | Allcock | |
| 7,237,425 | B1 | | 7/2007 | Wadsworth | |
| 7,360,390 | B2 | | 4/2008 | Lavalliere | |
| 7,588,487 | B1 | * | 9/2009 | Born, Jr. | 452/132 |
| 7,607,334 | B2 | | 10/2009 | Lechasseur | |
| 7,823,433 | B2 | | 11/2010 | Zhang | |
| 8,230,715 | B2 | | 7/2012 | Battenfeld et al. | |
| 8,495,828 | B1 | * | 7/2013 | Feldman et al. | 81/420 |
| 8,584,503 | B1 | | 11/2013 | Steiner et al. | |
| 8,613,210 | B2 | | 12/2013 | Wagner et al. | |
| 2006/0272379 | A1 | | 12/2006 | Marcon | |
| 2011/0259073 | A1 | | 10/2011 | Musser | |
| 2011/0271799 | A1 | | 11/2011 | Fachorn | |
| 2012/0279276 | A1 | | 11/2012 | Hofmann | |
| 2013/0327117 | A1 | | 12/2013 | Pearson | |

OTHER PUBLICATIONS

Midwest, "Sheet Metal Duct Tools" <http://www.midwestsnips.com/2011_products_part.php?prod_ID=35> publicly available since Jan. 24, 2013.

Lenox, "Lenox Hvac Tools" <http://www.lenoxtools.com/Pages/hvac-tools.aspx?Redirect=1> publicly available at least as early as Mar. 20, 2014.

* cited by examiner

FORMING HAND TOOL

RELATED APPLICATION

The present application claims priority to U.S. patent application Ser. No. 61/766,412, filed Feb. 19, 2013, the entire contents of which are hereby incorporated by reference.

FIELD

The present invention relates to hand tools and, more specifically, to hand tools for forming a work-piece, such as sheet metal.

SUMMARY

In one independent aspect, a hand tool may generally include a first handle and a second handle connected to the first handle for pivoting movement about a handle pivot point. The hand tool may also include a first jaw operably connected to the first handle and a second jaw operably connected to the second handle. A plurality of grooves and a plurality of shoulders may be located on at least one of the first jaw and the second jaw. Each shoulder may be created by an associated groove and provide a stop for a work-piece In another independent aspect, a hand tool for bending a work-piece to create a seam may be provided. The hand tool may include a first jaw operably connected to the first handle having a first inner surface and a second jaw operably connected to the second handle having a second inner surface. A plurality of grooves and a plurality of shoulders may be located on at least one of the first inner surface and the second inner surface. Each shoulder may be created by an associated groove and provide a stop for the work-piece.

In a further independent aspect, a hand tool may generally include a first and second groove located on each of the first inner surface and the second inner surface. A first and second shoulder may be created by the first and second grooves on each of the first inner surface and the second inner surface. The first shoulders may provide a first stop, and the second shoulders may provide a second stop for the work-piece.

Other independent aspects of the invention will become apparent by consideration of the detailed description and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Figure 1:
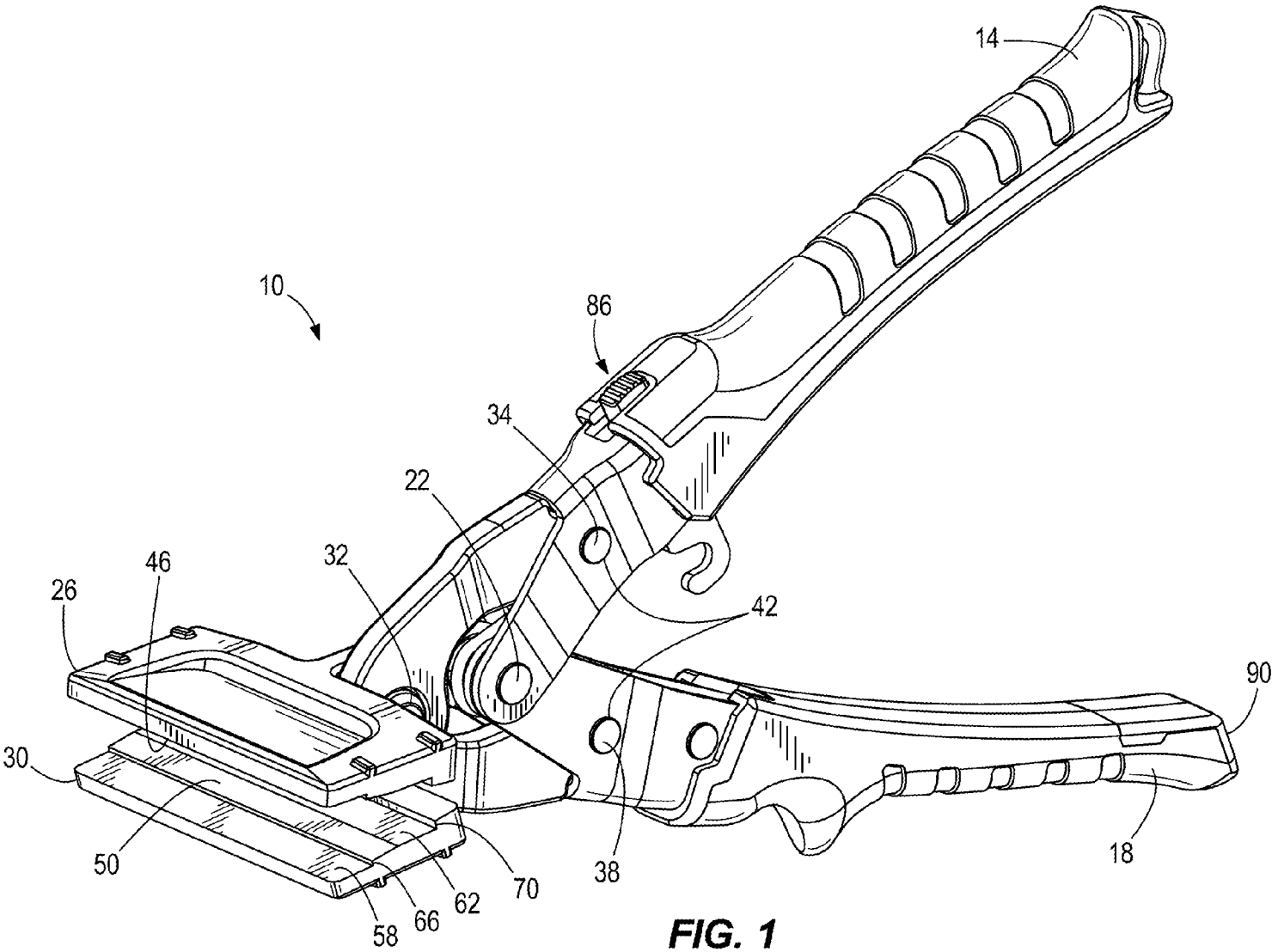
FIG. 1 is a perspective view of a hand tool according to an embodiment of the invention.
Figure 2:
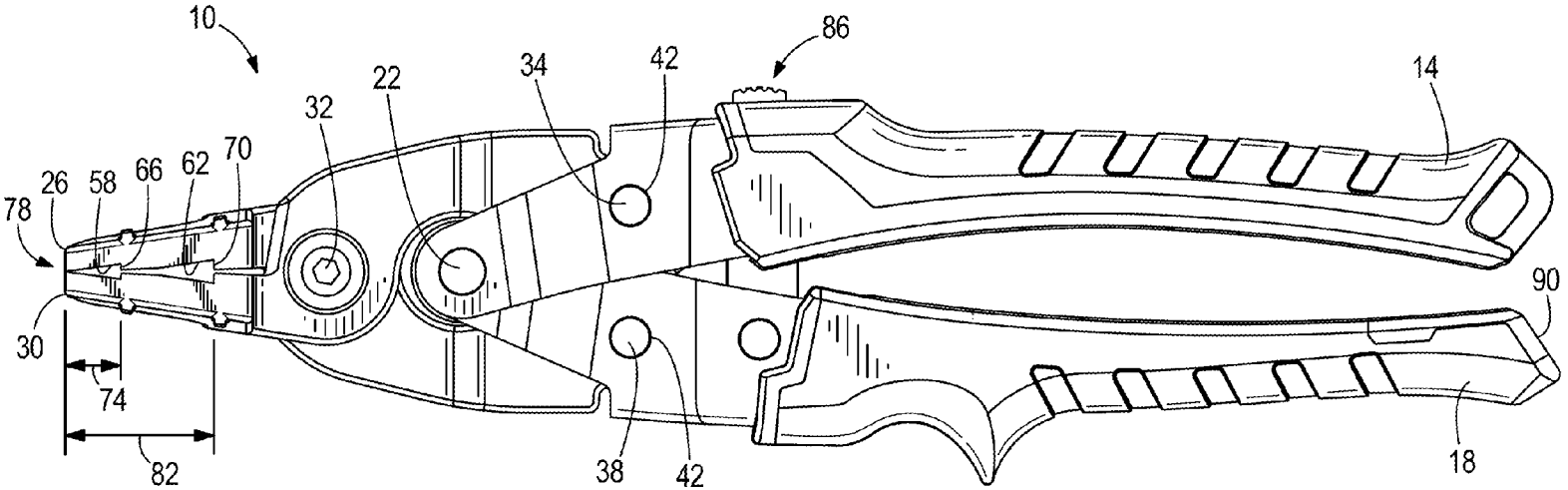
FIG. 2 is a side view of a hand tool according to the hand tool of FIG. 1.

FIGS. 1 and 2 illustrate a hand tool, such as a duct seamer 10, that can be used to bend sheet metal to create a seam in a duct. The seamer 10 includes handles 14, 18, pivotally connected at a handle pivot point 22, and jaws 26, 30, pivotally connected at a jaw pivot point 32 different than the handle pivot point 22. One jaw 30 is pivotally connected to the handle 14 at a first pivot point 34, and the other jaw 26 is pivotally connected to the handle 18 at a second pivot point 38. The jaws 26, 30 and the handles 14, 18 are thus pivotally connected in a compound-type pivot connection.

The illustrated pivot points 34, 38 are each formed by a bolt 42 having a low profile. In other words, the bolts 42 extend only minimally beyond the sides of the handles 14, 18 so that the bolts 42 do not snag or hang up on a tool pouch or tool belt.

The jaws 26, 30 have respective inner surfaces 46, 50 generally defining an engagement portion of the seamer 10 that interacts with a work-piece 54. The inner surfaces 46, 50 define grooves 58, 62 and shoulders 66, 70, and, in the illustrated construction, the grooves 58, 62 have an acutely angled surface that is non-planar with respective inner surface 46, 50.

In other embodiments (not shown), the grooves 58, 62 and shoulders 66, 70 may only be located on one of the jaws 26, 30. In other constructions (not shown), only one groove and only one shoulder may be provided. In still other constructions (not shown), three or more grooves and shoulders may be provided.

The shoulder 66 is located a first distance 74 from a front end 78 of the jaws 26, 30, and the shoulder 70 is located a second distance 82 from the front end 78. In the illustrated construction, the first distance 74 is approximately ⅜ inch, and the second distance 82 is approximately 1 inch, two of the most common fold depths. In other embodiments, the shoulders 66, 70 may be located at other suitable distances from the front end 78 of the jaws 26, 30 to provide other fold depths.

In the illustrated embodiment, the handles 14, 18 and the jaws 26, 30 are spring biased toward an open position (FIG. 1), and the seamer 10 includes a locking mechanism 86 (e.g., a relatively-movable catch and projection) operable to hold the handles 14, 18 and the jaws 26, 30 in the closed position (FIG. 2). The locking mechanism 86 is positioned to be easily actuated by the user's thumb, which allows for one handed operation of the seamer 10.

Figure 3:
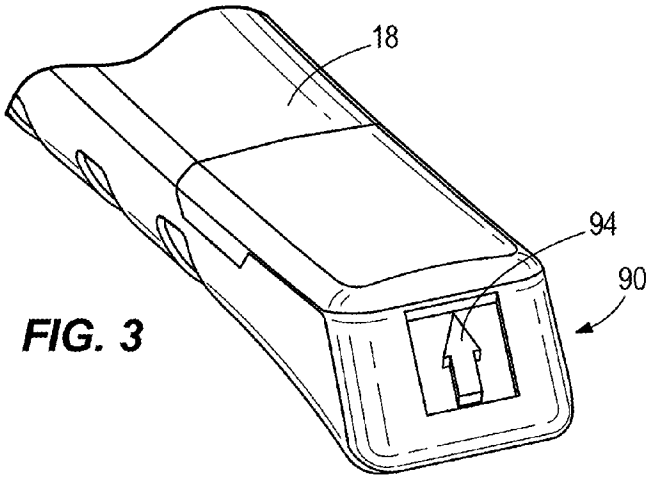
FIG. 3 is a perspective view of a handle end of the hand tool of FIG. 1.

An end 90 of the handle 18 can include indicia 94, such as an arrow (see FIG. 3), indicating that the tool 10 should be operated in an orientation with the arrow pointing up, which allows the user to actuate the locking mechanism 86 with their thumb. Therefore, a user can easily identify the correct orientation of the seamer 10 when the seamer 10 is placed in a tool belt or pouch with the handles 14, 18 pointed upwardly. Additionally or alternatively, the indicia may be an "S", which indicates to the user that the hand tool 10 is a seamer when the tool 10 is placed in the tool belt or pouch.

The handles 14, 18 are overmolded with elastomeric material (e.g., rubber) providing a durable and ergonomic grip for the user. Also, the handles 14, 18 are generally symmetrical to provide a comfortable grip in multiple hand positions.

Figure 4:
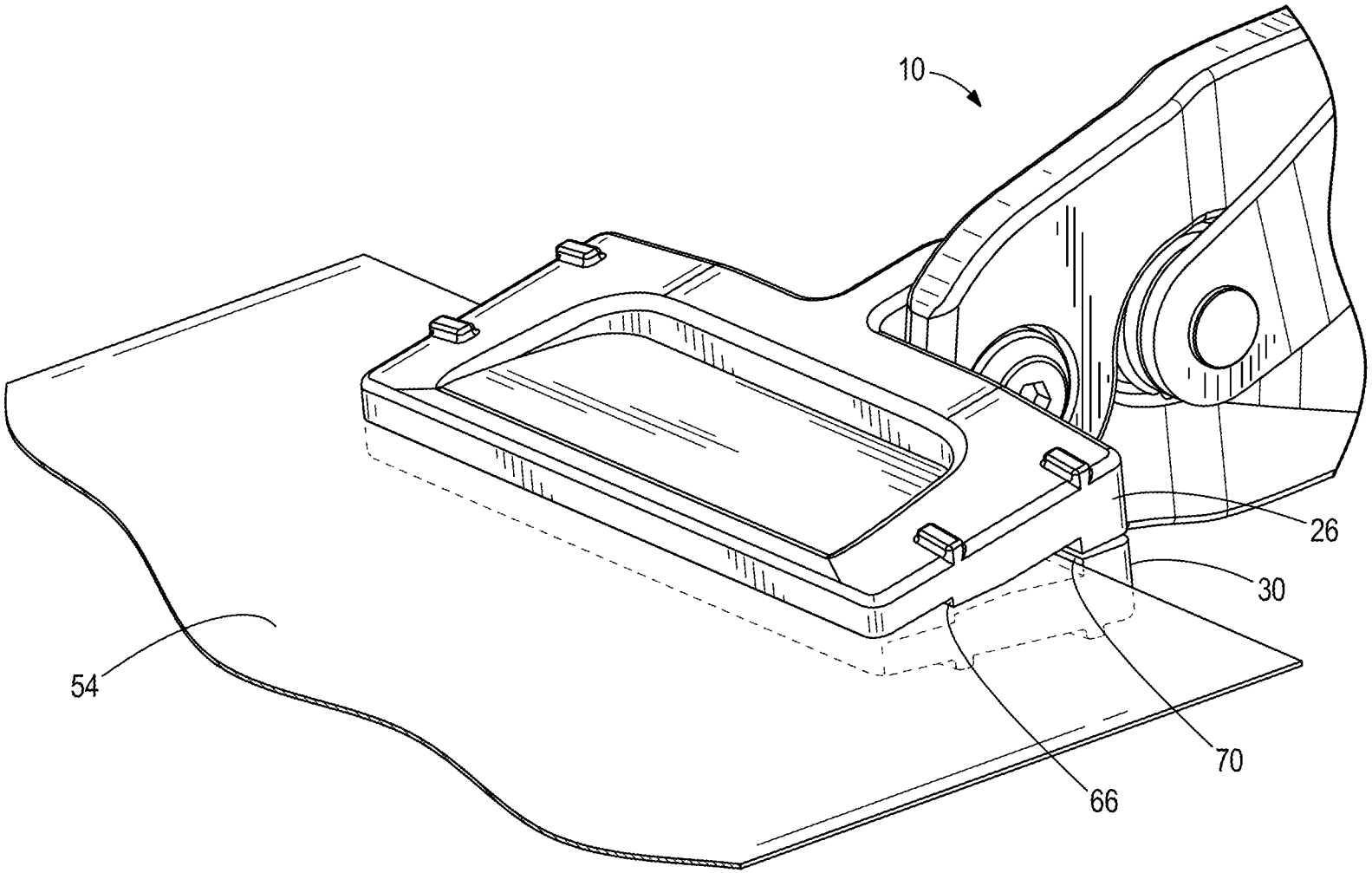
FIG. 4 is a perspective view of the hand tool of FIG. 1 during operation.

In operation, as illustrated in FIG. 4, the user can insert the work-piece 54 into the jaws 26, 30 until the work-piece contacts either the shoulder 66 or the shoulder 70, which act as a stop for the work-piece 54. Then, the user can close the jaws 26, 30 and bend or fold the work-piece 54 at the desired depth of either the first distance 74 (e.g., ⅜ inch) or the second distance 82 (e.g., 1 inch) depending on the shoulder 66, 70 being used. Although the illustrated jaws 26, 30 include the shoulders 66, 70 at the first and second distances 74, 82, respectively, the seamer 10 can also be used to fold at other depths.

One or more independent features and independent advantages of the invention may be set forth in the following claims:

What is claimed is:

1. A hand tool comprising:

a first handle;

a second handle connected to the first handle for pivoting movement about a handle pivot point;

a first jaw operably connected to the first handle, the first jaw including an inner surface, a first groove on the inner surface, and a second groove on the inner surface;

a second jaw operably connected to the second handle, the second jaw including the inner surface, a first groove on the inner surface of the second jaw, and a second groove on an inner surface of the second jaw;

a first shoulder created by the first groove of the first jaw and the first groove of the second jaw; and a second shoulder created by the second groove of the first jaw and second groove of the second jaw.

2. The hand tool of claim 1, wherein the first jaw and the second jaw together define a front end, the first shoulder at a first distance from the front end and the second shoulder at a second distance from the front end, the first distance and the second distance being different.

3. The hand tool of claim 2, wherein the first distance is approximately ⅜ inch.

4. The hand tool of claim 2, wherein the second distance is approximately 1 inch.

5. The hand tool of claim 1, wherein the first jaw and the second jaw are connected for pivoting movement about a jaw pivot point different than the handle pivot point.

6. The hand tool of claim 5, wherein the first jaw is connected to the first handle for pivoting movement about a first pivot point, and wherein the second jaw is connected to the second handle for pivoting movement about a second pivot point.

7. The hand tool of claim 6, wherein the first pivot point and the second pivot point are each formed by a bolt having a low profile.

8. The hand tool of claim 2, wherein the first groove of the first jaw and the first groove of the second jaw are both located the first distance from the front end, and wherein the second groove of the first jaw and the second groove of the second jaw are both located the second distance from the front end.

9. A hand tool for bending a work-piece to create a seam, the hand tool comprising:

a first handle;

a second handle connected to the first handle for pivoting movement about a handle pivot point;

a first jaw operably connected to the first handle and having a first inner surface;

a second jaw operably connected to the second handle and having a second inner surface;

a plurality of grooves on at least one of the first inner surface and the second inner surface; and a plurality of shoulders on the at least one of the first inner surface and the second inner surface, each shoulder being created by an associated groove, each shoulder providing a stop for the work-piece, wherein each groove has an acutely angle surface non-planar with the inner surface.

10. The hand tool of claim 9, wherein the first jaw and the second jaw each include a front end, one of the plurality of shoulders being at a first distance from the front end, another of the plurality of shoulders being at a second distance from the front end, the first distance and the second distance being different.

11. The hand tool of claim 10, wherein the first distance is approximately ⅜ inch.

12. The hand tool of claim 10, wherein the second distance is approximately 1 inch.

13. The hand tool of claim 9, wherein the first jaw and the second jaw are connected for pivoting movement a jaw pivot point different than the handle pivot point, wherein the first jaw is connected to the first handle for pivoting movement about a first pivot point and the second jaw is pivotally connected to the second handle for pivoting movement about a second pivot point.

14. The hand tool of claim 9, wherein at least one of the plurality of grooves is located on the first inner surface and another of the plurality of grooves is located on the second inner surface.

15. A hand tool for bending a work-piece to create a seam, the hand tool comprising:

a first handle;

a second handle connected to the first handle for pivoting movement about a handle pivot point;

a first jaw operably connected to the first handle and having a first inner surface;

a second jaw operably connected to the second handle and having a second inner surface;

a first groove and a second groove on each of the first inner surface and the second inner surface; and a first shoulder created by the first groove and a second shoulder created by the second groove on each of the first inner surface and the second inner surface, the first shoulders providing a first stop and the second shoulders providing a second stop for the work-piece.

16. The hand tool of claim 15, wherein the first jaw and the second jaw each include a front end, the first shoulder being at a first distance from the front end, the second shoulder being at a second distance from the front end, the first distance and the second distance being different.

17. The hand tool of claim 16, wherein the first distance is approximately ⅜ inch, and wherein the second distance is approximately 1 inch.

18. The hand tool of claim 15, wherein each groove has an acutely angle surface non-planar with the inner surface.

* * * * *